US009131795B2

(12) United States Patent
Didehvar et al.

(10) Patent No.: US 9,131,795 B2
(45) Date of Patent: Sep. 15, 2015

(54) ADJUSTABLE TENSION-MOUNTED CURVED ROD ASSEMBLY

(71) Applicant: Zenith Products Corporation, New Castle, DE (US)

(72) Inventors: Kaveh Didehvar, Hockessin, DE (US); Joseph Webb, Newark, DE (US); Alex Mikita, Haddonfield, NJ (US)

(73) Assignee: Zenith Products Corporation, New Castle, DE (US)

( * ) Notice: Subject to any disclaimer, the term of this patent is extended or adjusted under 35 U.S.C. 154(b) by 0 days.

(21) Appl. No.: 14/465,355

(22) Filed: Aug. 21, 2014

(65) Prior Publication Data

US 2014/0360959 A1 Dec. 11, 2014

Related U.S. Application Data

(60) Division of application No. 13/911,191, filed on Jun. 6, 2013, which is a continuation-in-part of application No. 13/676,800, filed on Nov. 14, 2012.

(51) Int. Cl.
*A47H 1/022* (2006.01)
*A47H 1/142* (2006.01)
(Continued)

(52) U.S. Cl.
CPC ..... *A47H 1/022* (2013.01); *A47H 1/142* (2013.01); *A47H 2001/0205* (2013.01); *A47H 2001/0215* (2013.01); *A47K 3/38* (2013.01); *Y10T 29/49947* (2015.01)

(58) Field of Classification Search
CPC ..... A47K 10/04; A47K 10/08; A47K 10/10; A47K 1/02; A47K 1/022; A47K 1/142; A47H 1/02; A47H 1/022; A47H 1/142; A47H 2001/0205; A47H 2001/0215
USPC ..... 211/16, 88.04, 105.1, 105.2, 105.3, 211/105.4, 105.5, 105.6, 123; 4/558, 610; 248/261, 262, 263, 264, 265
See application file for complete search history.

(56) References Cited

U.S. PATENT DOCUMENTS

D19,582 S 1/1890 Lau
653,642 A 7/1900 Darling
(Continued)

FOREIGN PATENT DOCUMENTS

CH 625601 A5 9/1981
CN 2221357 Y 3/1996
(Continued)

OTHER PUBLICATIONS

"Masterform Tool Company; Clevis Brackets", web page printout date: Feb. 11, 2010; original web posting date and product availability date: unknown, 1 page. (admitted prior art as of at least Oct. 1, 2013), retrieved from: http://www.masterformtool.com/catalog.asp?category=2&class=11&subclass=0&part=0.
(Continued)

*Primary Examiner* — Stanton L Krycinski
(74) *Attorney, Agent, or Firm* — Panitch Schwarze Belisario & Nadel LLP

(57) ABSTRACT

An adjustable rod assembly includes first and second tubes having first and second arcuate portions, third and fourth tubes of generally straight configurations, first and second end supports, and a tension rod mechanism secured within the third tube. The first tube has a first end, a second opposing end, and a planar surface extending from the second end toward the first end. The first tube is telescopingly received within the third tube and the second tube. The third tube is rotatable relative to the first tube and is rotatably secured within the fourth tube. The fourth tube is secured to the first end support and the second tube is secured to the second end support. The tension rod mechanism rotates with the third tube and has a threaded portion configured to extend from an interior of the third tube to an interior of the first tube.

12 Claims, 9 Drawing Sheets

(51) Int. Cl.

| | |
|---|---|
| *A47H 1/02* | (2006.01) |
| *A47K 3/38* | (2006.01) |

(56) References Cited

U.S. PATENT DOCUMENTS

| | | | | | |
|---|---|---|---|---|---|
| 839,959 | A | | 1/1907 | Richards | |
| 972,544 | A | * | 10/1910 | Lathrop | 248/264 |
| 1,253,486 | A | * | 1/1918 | Hammer | 211/105.4 |
| 1,481,730 | A | | 1/1924 | Oakley | |
| 1,502,154 | A | | 7/1924 | Meuller | |
| 1,675,111 | A | | 6/1928 | Kenney | |
| 1,679,881 | A | | 8/1928 | Simpson | |
| 1,721,305 | A | | 7/1929 | Koering | |
| 1,721,306 | A | | 7/1929 | Koering | |
| D81,134 | S | | 5/1930 | Henderson | |
| 1,837,340 | A | | 12/1931 | Schwartz | |
| 1,951,660 | A | * | 3/1934 | Klaudt | 211/123 |
| 1,953,450 | A | | 4/1934 | Thompson | |
| 2,032,842 | A | * | 3/1936 | Gould | 211/105.6 |
| 2,131,156 | A | | 9/1938 | Yardley | |
| 2,150,204 | A | | 3/1939 | Boye | |
| D119,576 | S | | 3/1940 | Kirsch | |
| 2,194,064 | A | | 3/1940 | Boye | |
| 2,195,979 | A | | 4/1940 | Ziolkowski | |
| 2,215,331 | A | | 9/1940 | Marsh | |
| 2,219,075 | A | | 10/1940 | Veau | |
| 2,250,003 | A | | 7/1941 | Boye | |
| 2,263,698 | A | * | 11/1941 | Hodgson | 280/748 |
| 2,293,168 | A | | 8/1942 | Pirone | |
| 2,383,104 | A | | 8/1945 | Allen | |
| 2,458,643 | A | | 1/1949 | Riley | |
| 2,462,321 | A | | 2/1949 | Holmes | |
| 2,519,996 | A | | 8/1950 | Blake | |
| 2,562,371 | A | | 7/1951 | Shannon | |
| 2,637,555 | A | | 5/1953 | Klaudt | |
| 2,778,030 | A | | 1/1957 | Goche | |
| 2,796,227 | A | | 6/1957 | Coakley | |
| 2,915,327 | A | | 12/1959 | Kreske | |
| 2,919,134 | A | | 12/1959 | Zuro | |
| 2,927,762 | A | | 3/1960 | Owsiak | |
| 2,974,806 | A | | 3/1961 | Seewack | |
| 3,023,909 | A | | 3/1962 | Henry | |
| 3,079,005 | A | | 2/1963 | Bednar | |
| 3,087,982 | A | | 4/1963 | Hayes | |
| 3,107,361 | A | | 10/1963 | Glutting, Sr. | |
| 3,418,665 | A | | 12/1968 | Long | |
| 3,429,452 | A | | 2/1969 | Johnson | |
| 3,493,121 | A | | 2/1970 | Doyle | |
| 3,504,805 | A | | 4/1970 | Doyle | |
| 3,521,758 | A | | 7/1970 | Guilfoyle, Sr. | |
| 3,557,390 | A | | 1/1971 | Ruggles et al. | |
| 3,572,511 | A | * | 3/1971 | Triplett | 211/105.6 |
| 3,687,499 | A | | 8/1972 | Guilfoyle, Sr. | |
| 3,836,174 | A | | 9/1974 | Holman, Jr. | |
| 3,864,760 | A | | 2/1975 | Bowen | |
| D237,356 | S | | 10/1975 | Andrews | |
| D248,434 | S | | 7/1978 | Clivio et al. | |
| 4,117,557 | A | | 10/1978 | McPeak et al. | |
| 4,229,842 | A | | 10/1980 | Gilmore | |
| 4,238,164 | A | | 12/1980 | Mazzolla | |
| 4,329,076 | A | | 5/1982 | Coreth | |
| 4,378,071 | A | | 3/1983 | Yakimicki | |
| 4,399,917 | A | | 8/1983 | Ohman | |
| 4,461,056 | A | | 7/1984 | Solinski | |
| 4,496,059 | A | | 1/1985 | Leiter | |
| 4,586,615 | A | | 5/1986 | Quitmann | |
| 4,635,889 | A | * | 1/1987 | Bell et al. | 248/265 |
| 4,636,106 | A | | 1/1987 | Waisbrod | |
| 4,662,593 | A | * | 5/1987 | Shames et al. | 248/222.14 |
| D293,297 | S | | 12/1987 | Wood | |
| 4,754,504 | A | | 7/1988 | Cellini | |
| 4,809,401 | A | | 3/1989 | Honig | |
| D301,976 | S | | 7/1989 | Greenhut et al. | |
| 4,895,471 | A | | 1/1990 | Geltz et al. | |
| 4,979,713 | A | * | 12/1990 | Bell | 248/224.8 |
| 5,022,104 | A | | 6/1991 | Miller | |
| 5,056,753 | A | | 10/1991 | Lunau et al. | |
| 5,103,531 | A | | 4/1992 | Perrotta | |
| D327,421 | S | | 6/1992 | Pagan | |
| 5,189,759 | A | | 3/1993 | Poore | |
| 5,216,766 | A | | 6/1993 | Lang | |
| 5,236,229 | A | | 8/1993 | Gonzalez | |
| 5,242,065 | A | | 9/1993 | Hoban | |
| 5,263,594 | A | | 11/1993 | Bianchi | |
| 5,281,063 | A | | 1/1994 | Austin, III | |
| D347,784 | S | | 6/1994 | Warshawsky | |
| 5,330,061 | A | | 7/1994 | Geltz | |
| 5,433,551 | A | | 7/1995 | Gordon | |
| 5,477,964 | A | | 12/1995 | Hart | |
| 5,484,056 | A | | 1/1996 | Wood | |
| D374,167 | S | | 10/1996 | Scholl | |
| 5,561,870 | A | | 10/1996 | Hertel | |
| D376,312 | S | | 12/1996 | Cahn et al. | |
| D377,753 | S | | 2/1997 | Meadows | |
| 5,603,475 | A | * | 2/1997 | Lim | 248/222.14 |
| D379,297 | S | | 5/1997 | Shires | |
| 5,662,297 | A | | 9/1997 | Christensen et al. | |
| D385,177 | S | | 10/1997 | Perry | |
| 5,678,703 | A | | 10/1997 | Sawyer | |
| D393,390 | S | | 4/1998 | Gottwald | |
| D397,928 | S | | 9/1998 | Wise | |
| 5,803,643 | A | | 9/1998 | Patelli et al. | |
| 5,876,147 | A | | 3/1999 | Longo | |
| 5,894,610 | A | | 4/1999 | Winter | |
| D416,785 | S | | 11/1999 | Ming-Hsiao | |
| D423,337 | S | | 4/2000 | Laga et al. | |
| D423,338 | S | | 4/2000 | Laga | |
| D426,142 | S | | 6/2000 | Moore | |
| D429,461 | S | | 8/2000 | Rowlay | |
| 6,101,675 | A | | 8/2000 | Goldstein | |
| D431,460 | S | | 10/2000 | Nichol | |
| D438,462 | S | | 3/2001 | Nichol | |
| 6,199,808 | B1 | * | 3/2001 | Lin | 248/222.14 |
| 6,216,287 | B1 | | 4/2001 | Wise | |
| 6,263,523 | B1 | * | 7/2001 | Moore | 4/610 |
| 6,302,180 | B1 | | 10/2001 | Yu | |
| 6,302,614 | B1 | | 10/2001 | Tseng | |
| 6,305,558 | B1 | | 10/2001 | Bates | |
| D466,399 | S | | 12/2002 | Jessee et al. | |
| 6,543,629 | B1 | | 4/2003 | Samelson | |
| 6,640,395 | B2 | | 11/2003 | Bush | |
| 6,651,830 | B2 | * | 11/2003 | Pan | 211/105.1 |
| 6,651,831 | B2 | | 11/2003 | Samelson | |
| D483,251 | S | | 12/2003 | Suero, Jr. | |
| 6,694,543 | B2 | * | 2/2004 | Moore | 4/610 |
| 6,715,163 | B1 | | 4/2004 | Cunningham | |
| D489,249 | S | | 5/2004 | Moore | |
| 6,745,909 | B1 | | 6/2004 | Lai | |
| D498,663 | S | | 11/2004 | Moore | |
| 6,824,000 | B2 | | 11/2004 | Samelson | |
| 6,845,955 | B1 | | 1/2005 | Hsu | |
| 6,862,776 | B2 | | 3/2005 | Chen | |
| 6,883,664 | B2 | | 4/2005 | Lee | |
| D506,920 | S | | 7/2005 | Taylor | |
| 6,913,156 | B1 | | 7/2005 | Wolff | |
| 7,024,706 | B2 | | 4/2006 | Hess | |
| D522,845 | S | | 6/2006 | Suero | |
| D522,846 | S | | 6/2006 | Suero, Jr. | |
| D522,847 | S | | 6/2006 | Suero, Jr. | |
| 7,055,680 | B2 | | 6/2006 | Liebers | |
| D525,115 | S | | 7/2006 | Harwanko | |
| 7,076,815 | B2 | | 7/2006 | Orpilla | |
| 7,111,336 | B1 | | 9/2006 | Lai | |
| D534,062 | S | | 12/2006 | van den Bosch | |
| D542,125 | S | | 5/2007 | Kaminski | |
| D542,897 | S | | 5/2007 | Harwanko | |
| D543,754 | S | | 6/2007 | Bauer et al. | |
| D543,756 | S | | 6/2007 | Gilbert | |
| D543,839 | S | | 6/2007 | Cooper et al. | |
| D544,786 | S | | 6/2007 | Barrese | |
| D547,165 | S | | 7/2007 | Barrese | |
| D550,542 | S | | 9/2007 | Worrall et al. | |
| D552,455 | S | | 10/2007 | Moore | |
| 7,296,772 | B2 | | 11/2007 | Wang | |

(56) References Cited

U.S. PATENT DOCUMENTS

| | | | | |
|---|---|---|---|---|
| D557,590 | S | 12/2007 | Moore | |
| D563,209 | S | 3/2008 | Samelson | |
| D563,526 | S | 3/2008 | Bauer | |
| 7,346,940 | B1 * | 3/2008 | Liao | 4/558 |
| D565,937 | S | 4/2008 | Tsai | |
| D567,637 | S | 4/2008 | Moore | |
| D576,022 | S | 9/2008 | Goldstein | |
| D577,991 | S | 10/2008 | Chen | |
| D586,647 | S | 2/2009 | Didehvar | |
| 7,512,997 | B2 | 4/2009 | Dewees | |
| 7,597,297 | B2 | 10/2009 | Isfeld et al. | |
| D618,542 | S | 6/2010 | Bertken | |
| 7,762,508 | B2 | 7/2010 | Xu | |
| D624,807 | S | 10/2010 | Barrese | |
| D624,808 | S | 10/2010 | Krawczak et al. | |
| 7,857,151 | B2 | 12/2010 | Barrese | |
| D631,273 | S | 1/2011 | O'Brien et al. | |
| D631,732 | S | 2/2011 | Krawczak et al. | |
| D633,780 | S | 3/2011 | Barrese | |
| D634,609 | S | 3/2011 | Bauer | |
| D636,660 | S | 4/2011 | O'Connell | |
| 7,926,127 | B2 | 4/2011 | Barrese | |
| 7,950,534 | B2 | 5/2011 | Kao | |
| D640,078 | S | 6/2011 | Gilbert | |
| 7,958,577 | B2 * | 6/2011 | Chang | 4/610 |
| 7,987,532 | B2 | 8/2011 | Bathurst et al. | |
| 7,987,534 | B2 | 8/2011 | Lin | |
| 7,997,428 | B2 | 8/2011 | Goldstein | |
| 8,015,633 | B2 | 9/2011 | Ho | |
| D648,619 | S | 11/2011 | Lowe | |
| D648,834 | S | 11/2011 | Gilbert | |
| 8,056,873 | B1 | 11/2011 | Hanley et al. | |
| D650,263 | S | 12/2011 | Barrese | |
| 8,069,507 | B2 * | 12/2011 | Didehvar et al. | 4/610 |
| 8,069,508 | B2 | 12/2011 | O'Connell | |
| 8,146,182 | B2 * | 4/2012 | Bauer | 4/558 |
| 8,185,981 | B2 * | 5/2012 | Didehvar et al. | 4/610 |
| 8,205,760 | B2 * | 6/2012 | Chang | 211/105.3 |
| 8,214,938 | B2 | 7/2012 | Hanley et al. | |
| 8,215,501 | B2 * | 7/2012 | Trettin et al. | 211/105.2 |
| 8,215,863 | B2 | 7/2012 | Sohn | |
| D667,295 | S * | 9/2012 | Harwanko | D8/376 |
| 8,297,870 | B2 | 10/2012 | Lenhart | |
| D670,556 | S | 11/2012 | Napier et al. | |
| D671,395 | S | 11/2012 | Harwanko | |
| 8,341,775 | B2 * | 1/2013 | Didehvar | 4/608 |
| 8,505,129 | B2 | 8/2013 | Parker et al. | |
| 8,505,749 | B2 * | 8/2013 | Trettin et al. | 211/105.2 |
| 8,522,373 | B2 * | 9/2013 | Bauer | 4/610 |
| D691,030 | S | 10/2013 | Lindo et al. | |
| D696,573 | S | 12/2013 | Didehvar | |
| 8,800,072 | B2 * | 8/2014 | Chang | 4/610 |
| 8,827,587 | B2 * | 9/2014 | Didehvar | 403/374.4 |
| 8,851,305 | B2 * | 10/2014 | Didehvar | 211/105.4 |
| 2002/0084394 | A1 * | 7/2002 | Barrett | 248/261 |
| 2003/0034316 | A1 | 2/2003 | Kao | |
| 2003/0052070 | A1 | 3/2003 | Weisenburger | |
| 2004/0178310 | A1 | 9/2004 | Marion | |
| 2004/0182806 | A1 | 9/2004 | Figueroa | |
| 2005/0053423 | A1 | 3/2005 | Doubler et al. | |
| 2005/0230587 | A1 | 10/2005 | Yang | |
| 2005/0268394 | A1 * | 12/2005 | Monk et al. | 4/558 |
| 2006/0070177 | A1 | 4/2006 | Bathurst et al. | |
| 2006/0156465 | A1 | 7/2006 | Lavi et al. | |
| 2006/0218717 | A1 | 10/2006 | van den Bosch | |
| 2007/0006377 | A1 * | 1/2007 | Moore | 4/558 |
| 2007/0006378 | A1 * | 1/2007 | Moore | 4/558 |
| 2007/0174956 | A1 * | 8/2007 | Heaslip | 4/558 |
| 2008/0022451 | A1 * | 1/2008 | Urlich et al. | 4/610 |
| 2008/0028513 | A1 * | 2/2008 | Didehvar | 4/610 |
| 2008/0115265 | A1 * | 5/2008 | Heaslip | 4/610 |
| 2008/0184479 | A1 | 8/2008 | Bathurst | |
| 2008/0210827 | A1 | 9/2008 | Samelson | |
| 2008/0245486 | A1 | 10/2008 | Brown | |
| 2008/0245940 | A1 | 10/2008 | Brown | |
| 2008/0282464 | A1 * | 11/2008 | Bauer | 4/610 |
| 2008/0289096 | A1 | 11/2008 | Patel | |
| 2009/0083905 | A1 | 4/2009 | O'Connell | |
| 2009/0242713 | A1 * | 10/2009 | Lowe et al. | 248/222.13 |
| 2011/0011813 | A1 | 1/2011 | Kao | |
| 2011/0113547 | A1 | 5/2011 | O'Connell | |
| 2012/0005823 | A1 | 1/2012 | Baines | |
| 2012/0023657 | A1 * | 2/2012 | Didehvar et al. | 4/610 |
| 2012/0036628 | A1 | 2/2012 | O'Connell | |
| 2012/0110729 | A1 * | 5/2012 | Baines | 4/610 |
| 2012/0123896 | A1 * | 5/2012 | Prodanovic et al. | 705/26.5 |
| 2012/0152872 | A1 | 6/2012 | Didehvar | |
| 2012/0152873 | A1 | 6/2012 | Didehvar | |
| 2012/0152874 | A1 | 6/2012 | Didehvar | |
| 2012/0167368 | A1 | 7/2012 | Napier et al. | |
| 2012/0241399 | A1 * | 9/2012 | Trettin et al. | 211/123 |
| 2012/0261370 | A1 * | 10/2012 | Chuang | 211/123 |
| 2012/0284914 | A1 | 11/2012 | Bauer | |
| 2012/0285914 | A1 * | 11/2012 | Carney | 211/123 |

FOREIGN PATENT DOCUMENTS

| | | | | |
|---|---|---|---|---|
| CN | 2228573 | Y | 6/1996 | |
| CN | 2349932 | Y | 11/1999 | |
| CN | 2566754 | Y | 8/2003 | |
| CN | 2705648 | Y | 6/2005 | |
| CN | 2835679 | Y | 11/2006 | |
| CN | 2893271 | Y | 4/2007 | |
| CN | 2902096 | Y | 5/2007 | |
| CN | 201001603 | Y | 1/2008 | |
| CN | 201187499 | Y | 1/2009 | |
| CN | 201189069 | Y | 2/2009 | |
| CN | 201363343 | Y | 12/2009 | |
| DE | 2051383 | A1 * | 10/1970 | |
| DE | 2460382 | C2 * | 12/1974 | |
| DE | 3539449 | C2 * | 11/1985 | |
| DE | 3539449 | A1 * | 5/1987 | F16B 7/00 |
| EP | 58405 | A1 * | 2/1982 | |
| EP | 58405 | B1 * | 2/1982 | |
| FR | 499003 | A * | 5/1919 | |
| FR | 2066283 | A5 * | 10/1970 | |
| GB | 1333384 | A * | 10/1969 | |
| GB | 2325397 | A | 11/1998 | |
| GB | 2400813 | A | 10/2004 | |
| GB | 2426693 | A | 12/2006 | |
| JP | 2000-046021 | A | 2/2000 | |
| JP | 2001-112561 | A | 4/2001 | |
| JP | 2004-036803 | A | 2/2004 | |
| JP | 2004-057213 | A | 2/2004 | |

OTHER PUBLICATIONS

"Medium- to Heavy-Duty Repairable Cylinders", Aro—20546 Clevis Bracket, SKU—40769, web page printout date: Feb. 11, 2010; original web posting date: unknown, 1 page. (admitted prior art as of at least Oct. 1, 2013), retrieved from: http://www.drillspot.com/products/40400/ingersoll-rand_20547_clevis_bracket.

"Clevis Bracket, Material: Forging, Weldment, or Ductile Iron", web page printout date: Feb. 11, 2010; original web posting date: unknown, 1 page. (admitted prior art as of at least Oct. 1, 2013), retrieved from: http://www.aggressivehydraulics.com/products/cylinder-component-parts/mounts/.

"Stanless Steel Curved Shower Rod, 1"×5'"; web page printout date: Feb. 10, 2010; original web posting date: unknown, 1 page. (admitted prior art as of at least Oct. 1, 2013), retrieved from:<http://plumbing.hardwarestore.com/51-283-shower-rods-and-holders/stanless-steel-curved-shower-rod-609421.aspx>.

Office Action issued Jul. 8, 2011 in U.S. Appl. No. 11/833,044 by Didehvar.

U.S. Appl. No. 13/253,617 by Didehvar, filed Oct. 5, 2011.

Office Action issued Dec. 11, 2012 in U.S Appl. No. 29/381,234 by Didehvar.

Notice of Allowance issued Jul. 24, 2012 in U.S. Appl. No. 29/422,283 by Harwanko.

U.S. Appl. No. 29/398,880 by Lindo, filed Aug. 5, 2011.

Office Action issued Feb. 16, 2012 in U.S. Appl. No. 13/253,617 by Didehvar.

(56) References Cited

OTHER PUBLICATIONS

U.S. Appl. No. 29/381,234 by Didehvar, filed Dec. 16, 2010.
U.S. Appl. No. 29/390,736 by Harwanko, filed Apr. 28, 2011.
U.S. Appl. No. 13/676,800 by Didehvar, filed Nov. 14, 2012.
U.S. Appl. No. 13/676,802 by Didehvar, filed Nov. 14, 2012.
Office Action issued Jul. 20, 2011 in U.S. Appl. No. 12/157,376 by Didehvar.
Office Action issued Nov. 22, 2011 in U.S. Appl. No. 12/157,376 by Didehvar.
U.S. Appl. No. 29/437,013 by Didehvar, filed Nov. 12, 2012.
U.S. Appl. No. 29/443,578 by Lindo, filed Jan. 18, 2013.
<http://www.amazon.com/Polder-Radial-Duo-Shower-Rod/dp/B001CEONRY>; Polder Radial Duo Shower Rod, web page printout date: Jun. 2, 2011; original web posting date and product availability date: unknown, 3 pages. (admitted prior art as of at least Oct. 1, 2013).
U.S. Appl. No. 29/398,881 by Walker, filed Aug. 5, 2011.
JCPenney, "Curved Smart Shower Rod" (admitted prior art as of at least Oct. 1, 2013), retrieved from http://www.jcpenney.com/curved-smart-shower-curtain-rod/prod.jump?ppId=pp5002324584&cmvc=JCP|dept20000012|cat100250092|RICHREL&grView=&eventRootCatId=&currentTabCatId=&regId=.
Photograph of Curved Shower Rod by Hardware Resources (admitted prior art as of at least Oct. 1, 2013).
Photograph of a curved shower rod distributed by Popular Bath Products, Inc. (admitted prior art as of at least Oct. 1, 2013).
Photographs of Tension Rod With End Cap and Cover (1)—Date Unknown—Admitted Prior Art as of at least Oct. 1, 2013.
Photographs of Tension Rod With End Cap and Cover (2)—Date Unknown—Admitted Prior Art as of at least Oct. 1, 2013.
Office Action issued Dec. 14, 2012 in U.S. Appl. No. 13/269,108 by Didehvar.
U.S. Appl. No. 13/752,724 by Lindo, filed Jan. 29, 2013.
Three photographs of Maytex Mills "EZ-Up" tension rod (date unknown) (admitted prior art as of at least Oct. 1, 2013).
Office Action issued Apr. 2, 2013 in U.S. Appl. No. 29/437,013 by Didehvar.
U.S. Appl. No. 29/451,499 by Harwanko, filed Apr. 3, 2013.
U.S. Appl. No. 13/911,191 by Didehvar, filed Jun. 6, 2013.
Office Action issued Jun. 21, 2013 in U.S. Appl. No. 13/752,724 by Lindo.
Office Action issued Jul. 8, 2013 in U.S. Appl. No. 13/269,108 by Didehvar.
Office Action issued Oct. 4, 2013 in U.S. Appl. No. 13/268,712 by Didehvar.
Office Action issued Oct. 11, 2013 in U.S. Appl. No. 13/269,030 by Didehvar.
Office Action issued Nov. 29, 2013 in U.S. Appl. No. 13/268,712 by Didehvar.
Office Action issued Dec. 6, 2013 in U.S. Appl. No. 13/269,108 by Didehvar.
Office Action issued Dec. 27, 2013 in U.S. Appl. No. 13/752,724 by Lindo.
U.S. Appl. No. 29/480,312 by Vacarro, filed Jan. 24, 2014.
U.S. Appl. No. 14/258,546 by Vaccaro, filed Apr. 22, 2014.
Office Action issued Jul. 2, 2014 in U.S. Appl. No. 13/269,108 by Didehvar.
U.S. Appl. No. 14/465,370 by Didehvar, filed Aug. 21, 2014.
U.S. Appl. No. 14/522,226 by Walker, filed Oct. 23, 2014.
U.S. Appl. No. 29/506,250 by Walker, filed Oct. 14, 2014.
Office Action issued Aug. 20, 2014 in U.S. Appl. No. 13/911,191 by Didehvar.
English translation of an Office Action issued Dec. 9, 2014 in CN Application No. 201110461894.0.
Office Action issued Mar. 18, 2015 in CA Application No. 2,668,653.
Office Action issued Apr. 9, 2015 in U.S. Appl. No. 13/676,800 by Didehvar.
Office Action issued May 8, 2015 in U.S. Appl. No. 29/480,312 by Vaccaro.

* cited by examiner

ADJUSTABLE TENSION-MOUNTED CURVED ROD ASSEMBLY

CROSS-REFERENCE TO RELATED APPLICATIONS

This application is a Divisional of U.S. patent application Ser. No. 13/911,191 filed Jun. 6, 2013, which is a Continuation-In-Part application of U.S. patent application Ser. No. 13/676,800 filed Nov. 14, 2012, the disclosures of which are incorporated herein by reference.

BACKGROUND OF THE INVENTION

An embodiment of the present invention relates generally to an adjustable tension rod, and more particularly, to an adjustable tension-mounted curved shower curtain rod assembly.

Adjustable length tension rods for use as curtain or shower curtain rods are generally known. These tension rods typically include a single straight rod having a first straight shaft that telescopingly receives a second straight shaft, wherein the first and second shafts house a long threaded stud. Curved shower curtain rods, however, typically require the use of screws, bolts, and the like in order to permanently fix the curved rod to support surfaces through. This results in curved shower curtain rods being more complex to install and the risk of permanently damaging the support surfaces upon removal of the curved rod.

It is therefore desirable to provide an adjustable curved shower curtain rod that is mounted between opposing support surfaces by a tension rod mechanism, thereby providing for simpler installation of the rod and reducing, if not eliminating, the risk of damage to the support surfaces upon removal of the curved rod.

BRIEF SUMMARY OF THE INVENTION

Briefly stated, one embodiment of the present invention is directed to an adjustable rod assembly comprising a first tube having a first arcuate portion, a first end, a second opposing end, and at least one planar surface extending from at least the second end of the first tube toward the first end of the first tube. The adjustable rod assembly further comprises a second tube having a second arcuate portion, a third tube of a generally straight configuration, a fourth tube of a generally straight configuration, a first end support, a second end support, and a tension rod mechanism fixedly secured within the third tube for rotational movement therewith. The first end of the first tube is telescopingly received within the third tube and the second end of the first tube is telescopingly received within the second tube. The third tube is rotatable relative to the first tube and is rotatably secured within the fourth tube. The fourth tube is secured to the first end support and the second tube is secured to the second end support. The tension rod mechanism has a threaded portion configured to extend from an interior of the third tube to an interior of the first tube.

Another embodiment of the present invention is directed to a method of installing an adjustable rod assembly. The steps of the method comprise providing an assembled adjustable rod assembly by: (i) providing a first tube having an arcuate portion, first and second opposing ends, and a planar surface extending from at least the second end toward the first end; (ii) providing a second tube having an arcuate portion, first and second opposing ends, and at least one aperture formed between the first and second opposing ends; (iii) providing a third tube having first and second opposing ends; (iv) telescopingly inserting the second end of the first tube in the second tube and telescopingly inserting the first end of the first tube in the third tube; (v) providing a first end support and a second end support; and (vi) pivotably securing the second end of the second tube to the second end support and rotatably securing the third tube to the first end support. The steps further comprise: b) positioning the assembled adjustable rod assembly between two opposing support surfaces, c) adjusting a length of the assembled adjustable rod assembly such that a respective rear surface of each of the first and second end supports is proximate a respective one of the opposing support surfaces, d) inserting a fastener through the at least one aperture of the second tube until a distal end of the fastener engages a portion of the planar surface of the first tube; and e) rotating the third tube about a longitudinal axis thereof until the respective rear surface of each of the first and second end supports directly contacts a respective one of the opposing support surfaces and the assembled adjustable rod assembly applies a compressive force against the opposing support surfaces.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1A:
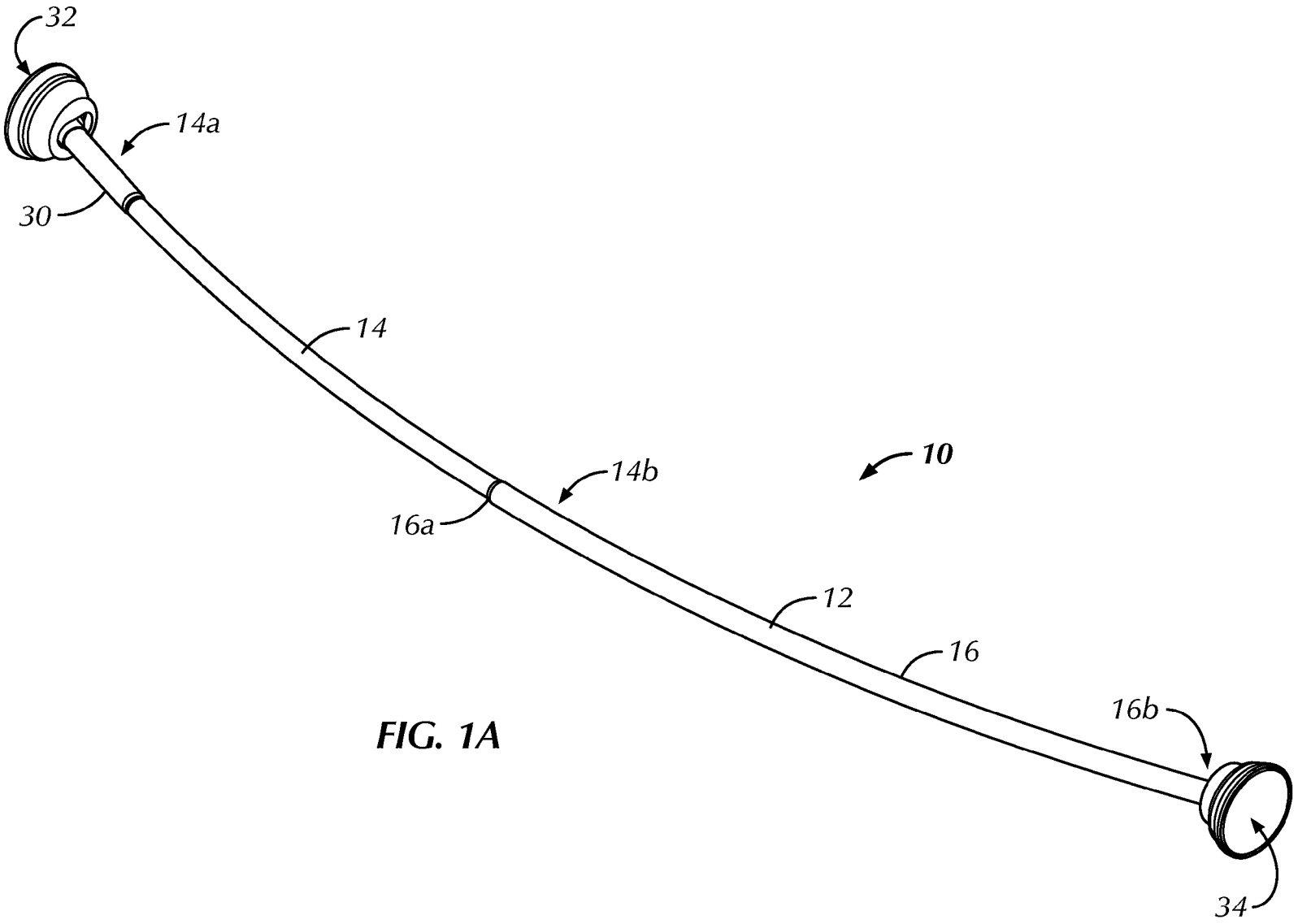
FIG. 1A is a left perspective view of an adjustable curved tension-mounted rod assembly in accordance with a first preferred embodiment of the present invention.

Certain terminology is used in the following description for convenience only and is not limiting. The words "right," "left," "top," "bottom" and "lower" designate directions in the drawings to which reference is made. The words "first," "second," "third" and "fourth" designate an order of operations in the drawings to which reference is made, but do not limit these steps to the exact order described. The words "inwardly" and "outwardly" refer to directions toward and away from, respectively, the geometric center of the device and designated parts thereof. Unless specifically set forth herein, the terms "a," "an" and "the" are not limited to one element, but instead should be read as meaning "at least one." The terminology includes the words noted above, derivatives thereof and words of similar import.

Figure 1B:
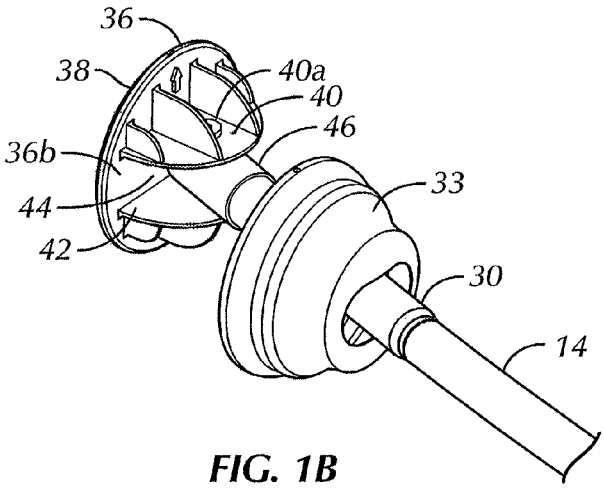
FIG. 1B is an enlarged perspective view of one end of the adjustable curved tension-mounted rod assembly shown in FIG. 1A.
Figure 1C:
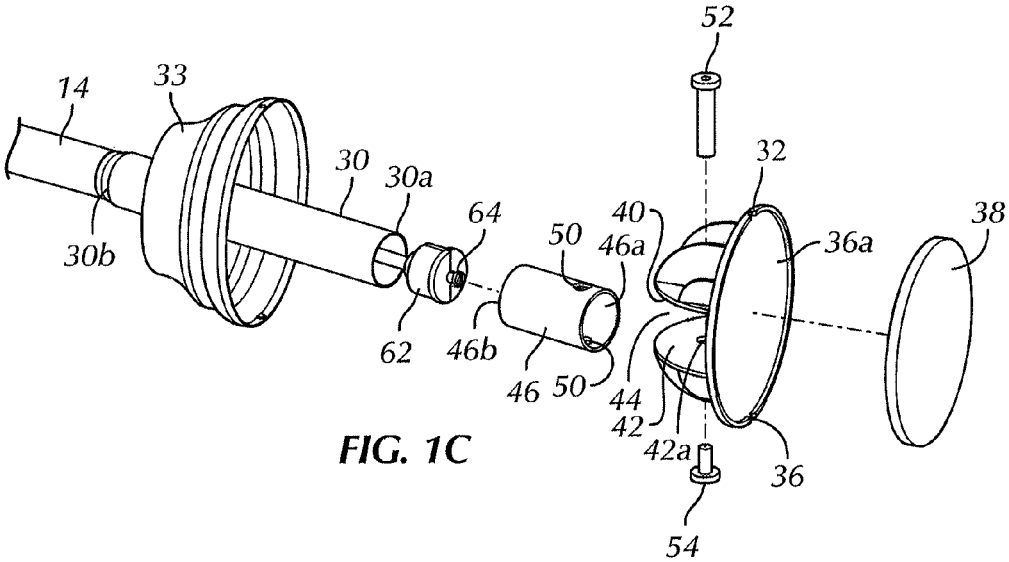
FIG. 1C is an exploded perspective view of the one end of the adjustable curved tension-mounted rod assembly shown in FIG. 1A.

Referring to the drawings in detail, wherein like numerals and characters indicate like elements throughout, there is shown in FIGS. 1A-1C a presently preferred embodiment of an adjustable curved tension-mounted rod assembly in accordance with the present invention. With reference initially to FIG. 1A, the adjustable curved tension-mounted rod assembly preferably functions as an adjustable curved curtain rod assembly, generally designated 10.

With particular reference to FIGS. 1A-2B, the adjustable curved rod assembly 10 can be secured between two opposing support surfaces (not shown), such as bathroom walls. The adjustable curved rod assembly 10 can be used as a shower curtain rod, or as a standard curtain rod. The adjustable curved rod assembly 10 comprises a generally curved rod 12 that may be positioned and maintained between two opposing support surfaces or walls.

The generally curved rod 12 comprises a first, inner tube 14 having an arcuate portion and a second, outer tube 16 having an arcuate portion. The first, inner arcuate tube 14 has a first end 14*a* and a second end 14*b*. The second, outer arcuate tube 16 has a first end 16*a* and a second end 16*b*. The second end 16*b* of the second tube 16 is provided with a pair of diametrically opposed apertures 17 (only shown in FIG. 2B). The first and second tubes 14, 16 are preferably made from a metal, and more preferably a non-corrosive metal, such as cold-rolled steel, stainless steel, aluminum, chrome or nickel or alloys or combinations thereof, but may also be constructed using wood, plastic, acrylic, or a like strong, lightweight material or a combination of materials. The first and second tubes 14, 16 may also be coated with any type of known coating for applying a non-corrosive finish to the curved rod 12.

The first and second tubes 14,16 are both preferably generally cylindrical in shape with a circular cross section. However, it will be understood by those skilled in the art that any other suitable cross-sectional shape may be used, including oval, square, rectangular, hexagonal, octagonal, and the like. Preferably, the outer diameter of the first tube 14 is at least slightly smaller than the inner diameter of the second tube 16, such that first tube 14 is telescopingly received within the second tube 16 in a reasonably tight fit. More particularly, in an assembled position of the adjustable curved rod assembly 10, the second end 14*b* of the first tube 14 is telescopingly positioned or received within the first end 16*a* of the second tube 16. Accordingly, the first and second tubes 14, 16 of the curved rod 12 are telescopingly configured.

Figure 2A:
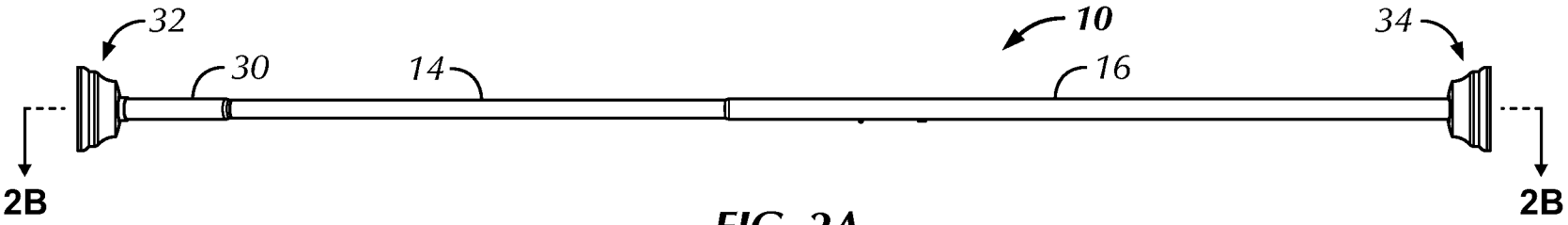
FIG. 2A is a front elevational view of an adjustable curved tension-mounted rod assembly in accordance with a second preferred embodiment of the present invention.
Figure 2B:
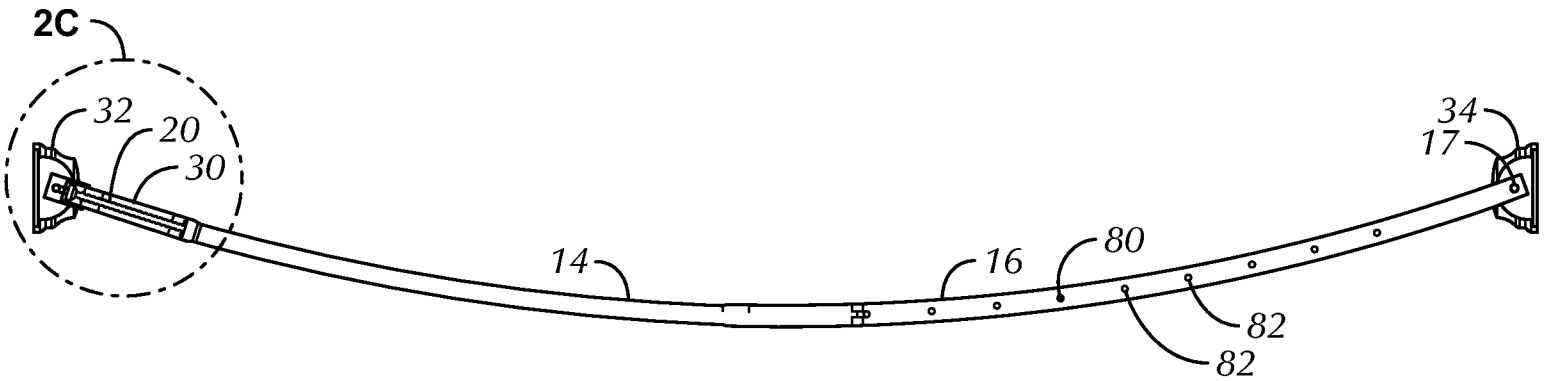
FIG. 2B is a top plan partial cross-sectional view of the adjustable curved tension-mounted rod assembly taken along line B-B of FIG. 2A.

Referring to FIGS. 2A-2B, in one embodiment, the first tube 14 preferably includes a spring-loaded pin 80 is configure to project from an exterior surface of the first tube 14. Specifically, the spring-loaded pin 80 preferably has a first, relaxed position, in which the pin 80 projects outwardly away from the exterior surface of the first tube 14, and a second, retracted position, in which the pin 80 is retracted or pushed inwardly toward the exterior surface of the first tube 14. The pin 80 is preferably biased toward the first, relaxed position. The second tube 16 is provided with a plurality of spaced-apart apertures 82, each of a sufficient size so as to be configured to receive the pin 80. More particularly, the diameter of each aperture 82 is preferably of a sufficient size so as to allow the pin 80 to pass therethrough.

In order to adjust the length of the curved rod 12, a user must first place the pin 80 in the second, retracted position, such as by pushing the pin 80 inwardly toward the first tube 14. Next, the user adjusts the curved rod 12 to the desired length by moving the telescoping first and second tubes 14, 16 toward each other to reduce the length of the curved rod 12 or away from each other to increase the length of the curved rod 12. Once the desired length is achieved and the pin 80 is aligned with one of the plurality of apertures 82, the pin 80 automatically transitions to its first, relaxed position, to which it is biased, by pass through the aperture 82 of the second tube 16 with which it is aligned. The engagement between the pin 80 of the first tube 14 and one of the apertures 82 of the second tube 16 ensures that the curved rod 12 maintains the desired length when secured between opposing support surfaces.

Figures 4, 4A:
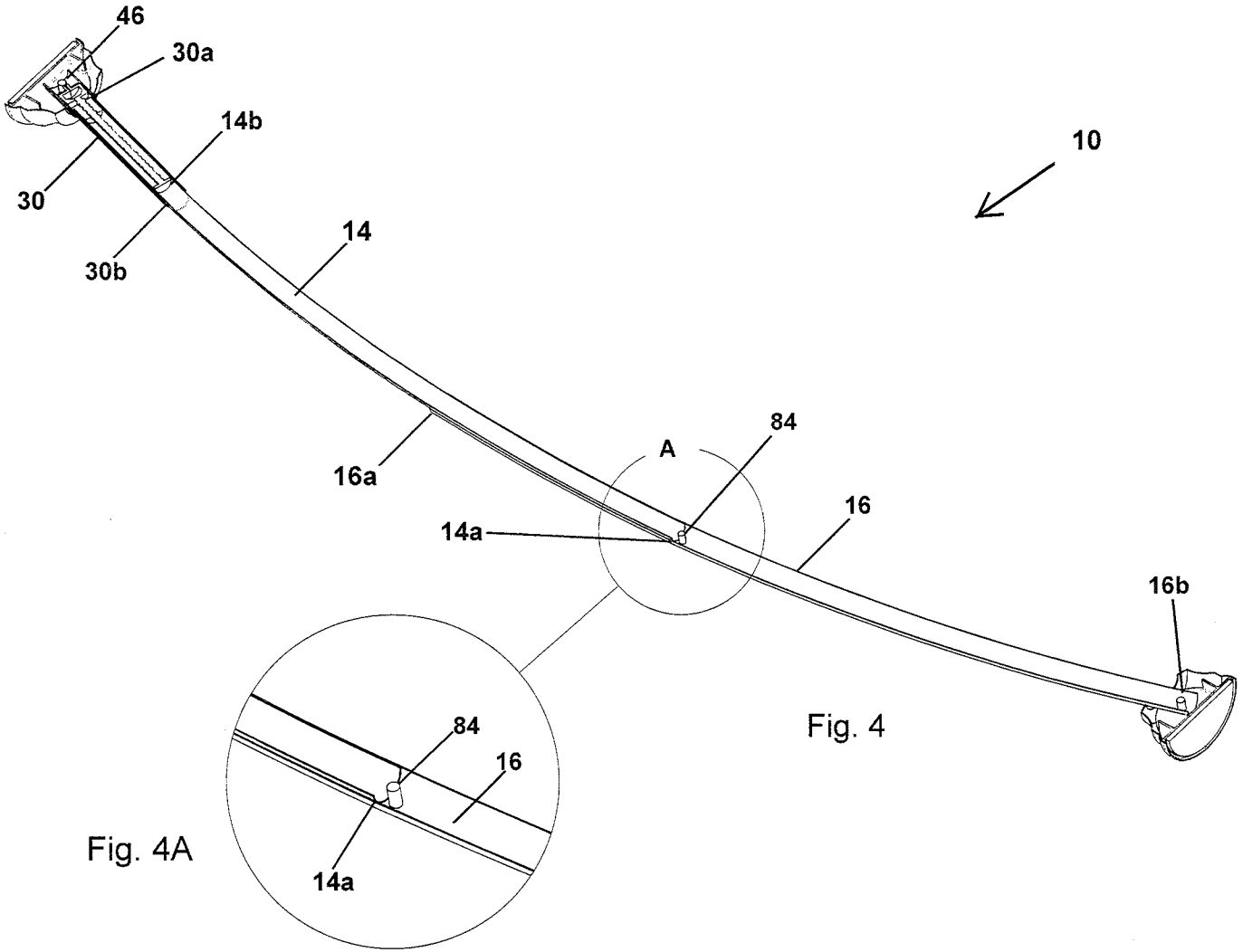
FIG. 4 is a left perspective cross-sectional view of an adjustable curved tension-mounted rod assembly in accordance with a third preferred embodiment of the present invention.
FIG. 4A is an enlarged left perspective cross-sectional view of the adjustable curved tension-mounted rod assembly taken about area A of FIG. 4.

Referring to FIGS. 4-4A, in another embodiment, the second tube 16 preferably includes a protrusion 84 which extends from an interior surface of the second tube 16 toward an interior of the second tube 16. The protrusion 84 is preferably a rivet 84 which acts as a travel stop for the first tube 14, such that the position of the rivet 84 is determinate of the overall length of the curved rod 12. Specifically, once the first end 14*a* of the first tube 14 contacts the rivet 84, the first tube and second tubes 14, 16 cannot move any further toward each other to reduce the length of the curved rod 12. Thus, the curved rod 12 has a pre-determined maximum length which is attained by moving the telescoping first and second tubes 14, 16 toward each other until the first end 14*a* of the first tube 14 contacts the rivet 84. It will be understood by those skilled in the art that while the preferred embodiment includes a rivet 84 as a travel stop, any appropriate travel stop structure may be used. For example, the interior of the second tube 16 may be provided with a welded pin, a welded protrusion, a protruding rib, and the like, as long as the interior of the second tube 16 includes some structure which contacts and prevents further movement of the first tube 14.

Preferably, the rivet 84 is provided at a position along a length of the outer tube 16, such that the resulting overall length of the adjustable curved rod assembly 10 is sufficient to span a distance of 60 inches. However, it will be understood by those skilled in the art that the rivet 84 may be provided at any position along the length of the outer tube 16, depending upon the desired overall lengths of the curved rod 12 and the adjustable curved rod assembly 10.

Figure 5:
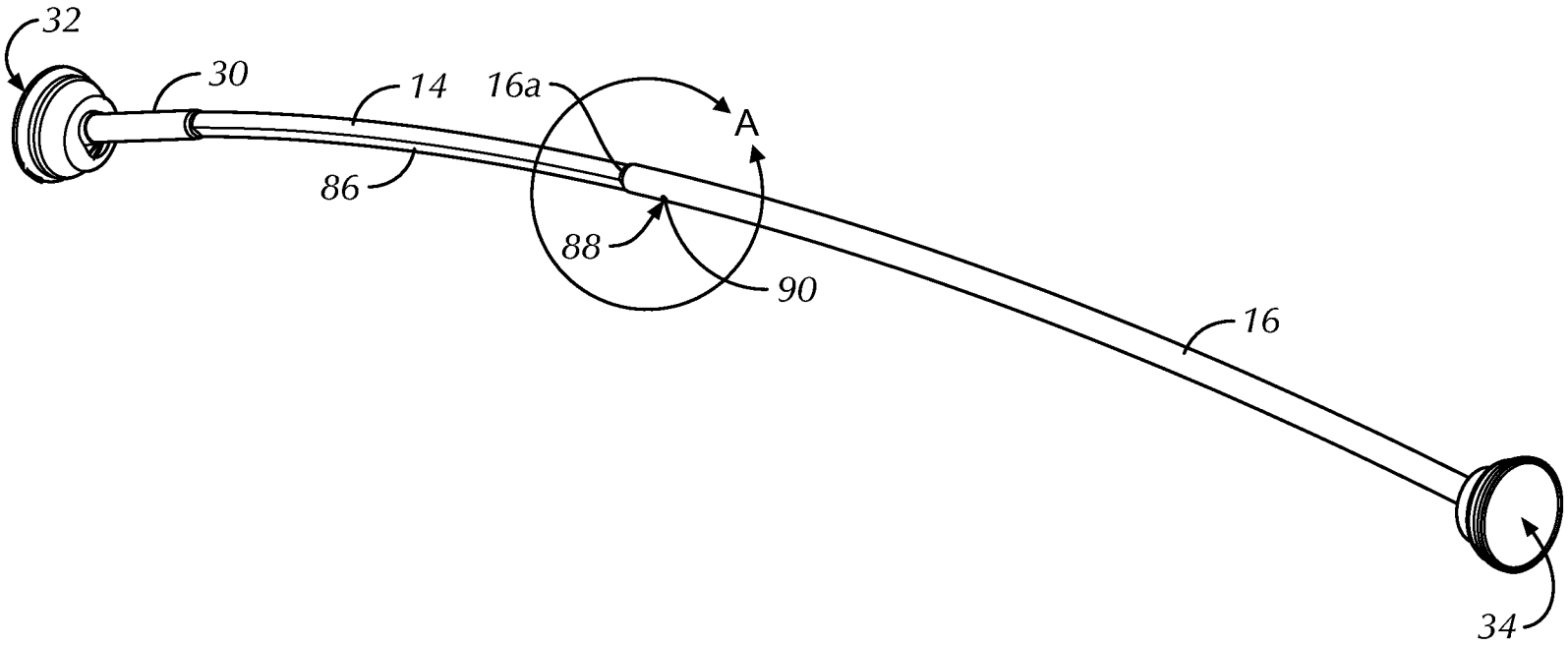
FIG. 5 is a left perspective view of an adjustable curved tension-mounted rod assembly in accordance with a fourth preferred embodiment of the present invention.
Figure 5A:
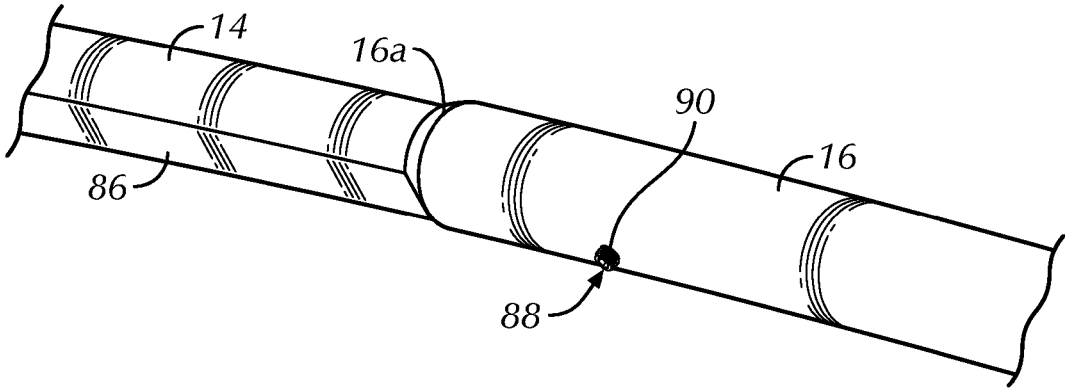
FIG. 5A is an enlarged partial perspective view of a portion of the adjustable curved tension-mounted rod assembly taken about area A of FIG. 5.
Figure 5B:
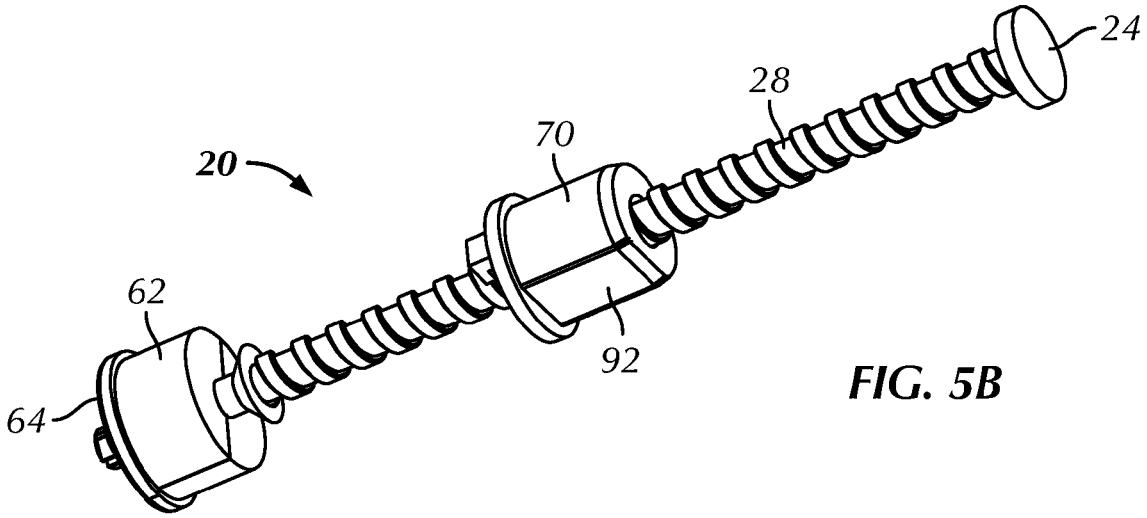
FIG. 5B is an enlarged perspective view of the tension mechanism 20 of the adjustable curved tension-mounted rod assembly shown in FIG. 5.
Figure 5C:
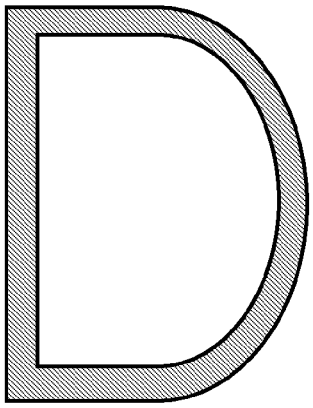
FIG. 5C is a front cross-sectional view the first tube of the adjustable curved tension-mounted rod assembly shown in FIG. 5; and, FIG. 6 is an enlarged exploded perspective view of the one end of the adjustable curved tension-mounted rod assemblies shown in FIG. 1A, 2A, 4 or 5.

Referring to FIGS. 5-5C, in another embodiment, one side of the first tube 14 is formed as a generally flat or planar surface 86. More preferably, a portion of the periphery of the first tube 14 extending from at least the first end 14*a* toward the second end 14*b* is formed as a planar surface 86. Most preferably, the planar surface 86 extends from the first end 14*a* completely to the second end 14*b* of the first tube 16. As such, the first tube 14 preferably has a D-shaped cross-section (see FIG. 5C). The second tube 16 is preferably provided with at least one aperture 88 of a sufficient size so as to be configured to receive a fastener 90, preferably a rotatable fastener 90, therethrough. More particularly, the diameter of the aperture 88 is preferably of a sufficient size so as to allow the fastener 90 to pass at least partially therethrough and engage a portion of the planar surface 86 of the first tube 14. As such, the planar surface 86 of the first tube 14 is preferably positioned within the second tube 16 so that the planar surface 86 of the first tube 14 faces the aperture 88 of the second tube 16.

The fastener 90 can be any fastener capable of fastening the first tube 14 to the second tube 16 to prevent relative movement of the tubes 14, 16. Preferably, the fastener 90 is a set screw, and more preferably a thumb set screw. However, it will be understood that the fastener 90 may alternatively be a clamp, a locking pin, a bolt, peg, dowel, nail, and the like. While it is preferred that the second tube 16 be provided with only one aperture 88 and one fastener 90 for ease of manufacturing, it will be understood by those skilled in the art that the second tube 16 may be provided with a plurality of apertures 88 and/or fasteners 90.

In order to adjust the length of the curved rod 12 according to the embodiment of FIGS. 5-5B, the user adjusts the curved rod 12 to the desired length by moving the telescoping first and second tubes 14, 16 toward each other to reduce the length of the curved rod 12 or away from each other to increase the length of the curved rod 12. Once the desired length of the curved rod 12 is achieved, the user inserts the fastener 90 through the aperture 88 of the second tube 16 until a distal end of the fastener 90 engages the first tube 14 and, more particularly, until the distal end of the fastener 90 engages the planar surface 86 of the first tube 14. The engagement between the fastener 90 and the planar surface 86 of the first tube 14 ensures that the curved rod 12 maintains the desired length when secured between opposing support surfaces.

Referring to FIGS. 1A-1C, the adjustable curved rod assembly 10 further comprises a third tube 30 which is preferably generally cylindrical in shape with a circular cross section and which preferably has a generally straight configuration. The third tube 30 is preferably a rotatable tube 30 having a first end 30*a* and a second end 30*b*. More preferably, the first and second ends 30*a*, 30*b* of the rotatable tube 30 are open ends. The rotatable tube 30 is preferably made from a metal, and more preferably a non-corrosive metal, such as cold-rolled steel, stainless steel, aluminum, chrome or nickel or alloys or combinations thereof, but may also be constructed using wood, plastic, acrylic, or a like strong, lightweight material or a combination of materials. The rotatable tube 30 may also be coated with any type of known coating for applying a non-corrosive finish to the tube 30. More preferably, the rotatable tube 30 is made from the same material as the first and second tubes 14, 16 of the curved rod 12.

The inner diameter of the rotatable tube 30 is at least slightly larger than the outer diameter of the first tube 14 of the curved rod 12, such that the first end 14*a* of the first tube 14 is configured to pass through the open second end 30*b* and at least slightly into the rotatable tube 30. Accordingly, in the assembled position of the adjustable curved rod assembly 10, the first end 14*a* of the first tube 14 is telescopingly positioned or received within the second end 30*b* of the rotatable tube 30 (see FIG. 2C). Further, in the assembled position of the adjustable curved rod assembly 10, the longitudinal axis L1 of the rotatable tube 30 is preferably generally aligned with the longitudinal axis L2 of the first end 14*a* of the first tube 14. As such, in the assembled position of the adjustable curved rod assembly 10, the rotatable tube 30 is preferably freely rotatable relative to the first tube 14 of the curved rod 12 positioned therein.

Figure 2C:
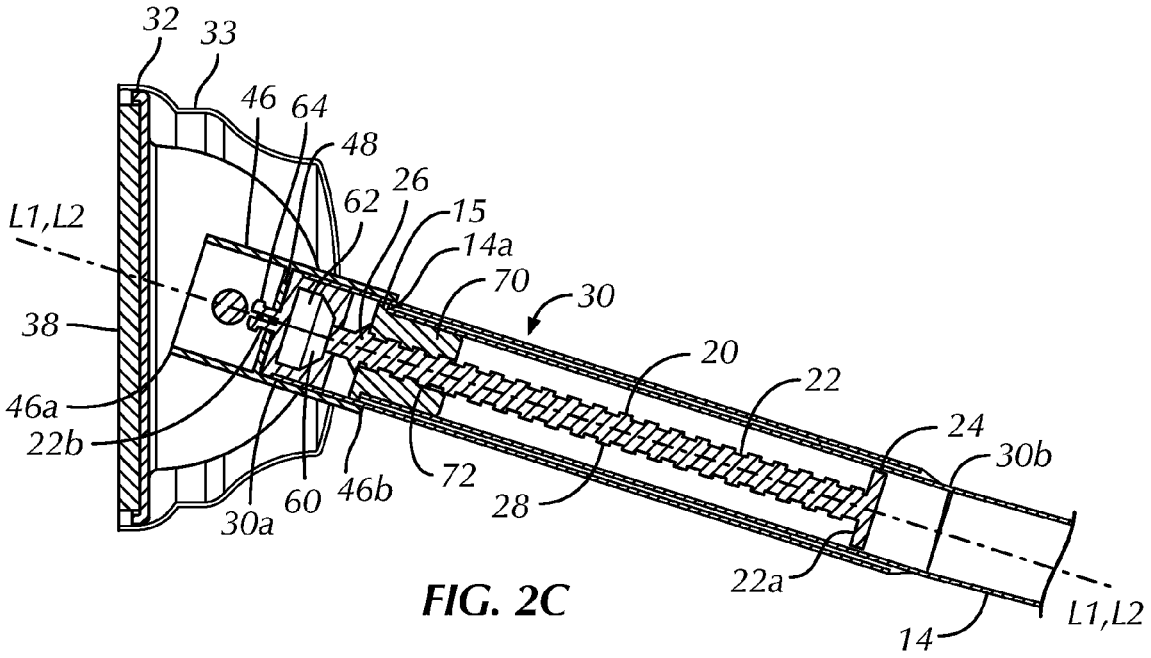
FIG. 2C is an enlarged top plan cross-sectional fragmentary view of the adjustable curved tension-mounted rod assembly taken about area 2C of FIG. 2B.

Preferably, the rotatable tube 30 and the first end 14*a* of the first tube 14 of the curved rod 12 are each at least partially hollow, such that a tension mechanism 20 can be fitted therein (see FIGS. 1C and 2C). More specifically, the tension mechanism 20 is fixedly secured within an interior of the rotatable tube 30, and more preferably within the first end 30*a* of the rotatable tube 30, such that the tension mechanism 20 is configured to rotate with the rotatable tube 30. U.S. Pat. No. 5,330,061, which is assigned to Zenith Products Corp. and is incorporated herein by reference, describes a preferred embodiment of a tension mechanism of the type for use in the adjustable curved rod assembly 10.

Specifically, referring to FIG. 2C, the tension mechanism 20 of the adjustable curved rod assembly 10 is preferably a tension rod mechanism 20 comprising a rod 22 having a first end 22*a*, a second end 22*b*, a first stop piece 24 and a second stop piece 26. The first stop piece 24 is provided at the first end 22*a* of the rod 22, while the second stop piece 26 is positioned in between the first and second ends 22*a*, 22*b*. The first and second stop pieces 24, 26 may be shaped differently, as shown in FIG. 2C, or alternatively may have substantially identical structures. As will be discussed more fully herein, the first and second stop pieces 24, 26 define the limits to which the overall length of the adjustable curved rod assembly 10 can be adjusted.

The rod 22 comprises a threaded portion 28 and a connector portion 60. The threaded portion 28 of the rod 22 is defined by the portion of the rod 22 having an external thread pattern. Preferably, at least one part of the threaded portion 28 of the rod 22 is flexible. More preferably, the entirety of the threaded portion 28 of the rod 22 is flexible. However, it will be understood by those skilled in the art that a portion or the entirety of the threaded portion 28 of the rod 22 may alternatively be generally rigid.

The connector portion 60 of the rod 22 preferably comprises a connector 62. At a distal tip of the connector 62, a locking pin 64 is integrally formed with the connector 62. However, it will be understood that the locking pin 64 may be formed as a separate component which is secured to the connector 62 by any conventional means. The locking pin 64 protrudes outwardly away from a surface of the connector 62 and the threaded portion 28 of the rod 22.

In one embodiment, as shown in FIG. 2C, the threaded portion 28 of the rod 22 extends from the first end 22*a* of the rod 22 and the first stop piece 24 to the second stop piece 26. In this embodiment, the connector portion 60 preferably extends from the second stop piece 26 to the second end 22*b* of the rod 22, with the connector 62 defining the second end 22*b* of the rod 22.

In the assembled position of the adjustable curved rod assembly 10, the first end 14*a* of the first tube 14 is telescopingly positioned within the interior of the rotatable tube 30, the connector portion 60 of the tension mechanism 20 is fixedly secured within the first end 30*a* of the rotatable tube 30 and at least a portion of the threaded portion 28 of the rod 22 extends into and is rotatably secured within the first end 14*a* of the first tube 14. More preferably, the connector 62 of the rod 22 is fixedly secured within the first end 30*a* of the rotatable tube 30 and at least a portion of the threaded portion 28 of the rod 22 extends from an interior of the rotatable tube 30 to an interior of the first end 14*a* of the first tube 14.

Accordingly, rotation of the rotatable tube 30 about the longitudinal axis L1 thereof, relative to the first tube 14, also causes rotation of the rod 22 of the tension mechanism 20 relative to the first tube 14.

In one embodiment, at least a portion of an interior surface of the first end 14*a* of the first tube 14 preferably includes a threaded portion which is configured to threadingly engage the threaded portion 28 of the rod 22 to rotatably secure the rod 22 within the first tube 14. In another embodiment, the interior of the first end 14*a* of the first tube 14 includes a threaded bushing or nut 70 configured to threadingly engage the threaded portion 28 of the rod 22 to rotatably secure the rod 22 therein. The threaded bushing 70 is preferably fixedly secured within the first end 14*a* of the first tube 14. More preferably, the threaded bushing 70 is positioned substantially a distal-most tip of the first end 14*a* of the first tube 14. However, it will be understood by those skilled in the art that the threaded bushing 70 may be positioned at some other location within the first tube 14, as long as the location allows extension and collapse of the adjustable curved rod assembly 10 to the desired length.

The threaded bushing 70 is preferably made from a metal, such as cold-rolled steel, stainless steel, aluminum, chrome or nickel or alloys or combinations thereof, but may also be constructed using wood, plastic, acrylic, or a like strong, lightweight material or a combination of materials. The threaded bushing 70 may be secured within the first tube 14 by any conventional means, such as a flange connection, a dimple connection, adhesives, welds and the like. Preferably, the threaded bushing 70 is secured within the first end 14*a* of the first tube 14 by a flange 15 which extends circumferentially from the threaded bushing 70 around the distal-most tip of the first end 14*a* of the first tube 14.

Preferably, an exterior surface of the threaded bushing 70 is in direct contact with an interior surface of the first tube 14. In the embodiment of FIGS. 5-5B, one side of the bushing 70 is formed as a generally flat or planar surface 92. As such, the bushing 70 preferably has a D-shaped cross-section. More preferably, a portion of the periphery of the bushing 70 extending along a length thereof is formed as an exterior planar surface 92 configured to engage and mate with the interior of the planar surface 86 of the first tube 14.

An interior surface of the threaded bushing 70 is preferably defined by a centrally located and threaded through-hole 72. The thread pattern of the through-hole 72 corresponds to or complements that of the threaded portion 28 of the rod 22. The centrally located through-hole 72 of the threaded bushing 70 also includes an inner diameter that is substantially equal to the outer diameter of the threaded portion 28 of the rod 22. Accordingly, in the assembled position of the adjustable curved rod assembly 10, the threaded portion 28 of the rod 22 is positioned within the centrally located through-hole 72 of the threaded bushing 70, such that the threaded portion 28 of the rod 22 rotates within the threaded bushing 70.

Preferably, rotation of the rotatable tube 30 causes the first tube 14 and the rotatable tube 30 to move axially relative to each other. More particularly, rotation of the rotatable tube 30 in a first direction about the longitudinal axis L1 thereof preferably causes the first tube 14 and the rotatable tube 30 to move axially away from each other, thereby extending the overall length of the adjustable curved rod assembly 10. Rotation of the rotatable rod 30 in the first direction, and more particularly movement of the threaded portion 28 within the threaded bushing 70 as the rotatable rod 30 is rotated in the first direction, is preferably limited by the second stop piece 26.

Rotation of the rotatable tube 30 in a second direction, opposite the first direction, about the longitudinal axis L1 thereof preferably causes the first tube 14 and the rotatable tube 30 to move axially toward each other, thereby reducing the overall length of the adjustable curved rod assembly 10. Rotation of the rotatable rod 30 in the second direction, and more particularly movement of the threaded portion 28 within the threaded bushing 70 as the rotatable rod 30 is rotated in the second direction, is preferably limited by the first stop piece 24.

Figure 3:
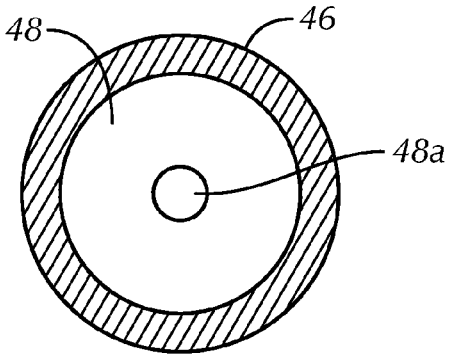
FIG. 3 is an enlarged elevational cross-sectional view of a fourth tube of the adjustable curved tension-mounted rod assembly shown in FIG. 1A.

Referring to FIGS. 1B-1C and 3, the adjustable curved rod assembly 10 further comprises a fourth tube 46 which is preferably generally cylindrical in shape with a circular cross section and which preferably has a generally straight configuration. The fourth tube 46 is preferably a generally cylindrical coupler 46. The coupler 46 has a first end 46*a* and a second end 46*b*. In one embodiment, the coupler 46 preferably includes at least one generally closed interior and intermediate wall 48 at a position between the opposing first and second ends 46*a*, 46*b*. Preferably, the interior and intermediate wall 48 includes an aperture or groove 48*a* centrally formed therein. More preferably, the interior and intermediate wall 48 includes a centrally-located aperture 48*a* formed therethrough. The first end 46*a* of the coupler 46 preferably includes a pair of diametrically opposed apertures 50.

The inner diameter of the coupler 46 is slightly larger than the outer diameter of the rotatable tube 30, such that the rotatable tube 30 can be positioned within an interior of the coupler 46. More particularly, in the assembled position of the adjustable curved rod assembly 10, the first end 30*a* of the rotatable tube 30 is telescopingly position and received within the second end 46*b* of the coupler 46. Preferably, the rotatable tube 30 is rotatably secured within the coupler 46, such that the rotatable tube 30 is freely rotatable relative to the coupler 46.

In one embodiment, the preferred structural configuration of the rotatable tube 30 and the coupler 46 is achieved by rotational engagement of the locking pin 64 and the aperture or groove 48*a* of the intermediate wall of the coupler 46. More particularly, in one embodiment, the first end 30*a* of the rotatable tube 30, in which the connector 62 of the tension mechanism 20 is fixedly secured, is positioned within the second end 46*b* of the coupler 46 until the locking pin 64 of the connector 62 passes through the aperture 48*a* of the intermediate wall 48. Preferably, at least a portion of the locking pin 64 has a diameter which is at least slightly larger than that of the aperture 48*a*, such that once the locking pin 64 is positioned within the aperture 48*a* (e.g., by snapping the locking pin 64 into position), the locking pin 64 is frictionally engaged by the aperture 48*a* and is not easily detached or removed from the aperture 48*a*.

Such an engagement between the tension mechanism 20 and the coupler 46 secures the tension mechanism 20 to the coupler 46 in a stable manner, while simultaneously enabling both the rotatable tube 30 and the tension mechanism 20 to rotate relative to the coupler 46 and the first tube 14 of the curved rod 12, as necessary for adjustment of the overall length of the adjustable curved rod assembly 10 and the generation of a tensile or compressive force which holds the adjustable curved rod assembly 10 in place between opposing supporting surfaces. More particularly, rotation of the rotatable tube 30 in the first direction about the longitudinal axis L1 thereof preferably causes the first tube 14 and the coupler 46 to move axially away from each other, thereby extending the overall length of the adjustable curved rod assembly 10 to create the needed tension against the opposing support surfaces. Conversely, rotation of the rotatable tube 30 in the second, opposite direction, about the longitudinal axis L1 thereof preferably causes the first tube 14 and the coupler 46 to move axially toward each other, thereby reducing the overall length of the adjustable curved rod assembly 10.

The coupler 46 is preferably made from a metal, and more preferably a non-corrosive metal, such as cold-rolled steel, stainless steel, aluminum, chrome or nickel or alloys or combinations thereof, but may also be constructed using wood, plastic, acrylic, or a like strong, lightweight material or a combination of materials. The coupler 46 may also be coated with any type of known coating for applying a non-corrosive finish to the coupler 46. More preferably, the coupler 46 is made from the same material as the first and second tubes 14, 16 of the curved rod 12 and the rotatable tube 30.

The adjustable curved rod assembly 10 further comprises a first end support 32 and a second end support 34. Each of the first and second end supports 32, 34 is configured to be removably mounted to a respective support surface (not shown) of the two opposing support surfaces. The coupler 46 is secured to the first end support 32 and the second tube 16 of the curved rod 12 is secured to the second end support 34. More preferably, the first end support 32 receives the first end 46*a* of the coupler 46 in a stable manner. The second end support 34 receives the second end 16*b* of the second tube 16 in a similarly stable manner.

The first end and second end supports 32, 34 are preferably made from a lightweight, high strength material, such as aluminum or steel, but could be made of other materials, such as a polymeric material, chrome or nickel, or alloys or combinations thereof, but may also be constructed using wood, plastic, acrylic, or a like strong, lightweight material or a combination of materials without departing from the spirit and scope of the invention. Preferably, first and second end supports 32, 34 are made from the same material as the first and second tubes 14, 16 of the curved rod 12, the rotatable tube 30 and the coupler 46.

The first end support 32 is preferably a mirror image of the second end support 34. For convenience in the description and clarity in the drawings, only the first end support 32 is described in detail and completely labeled in the drawings with the understanding that the second end support 34 includes similar features.

Referring to FIGS. 1B-1C, the first end support 32 includes a base plate 36 having a first, rear face 36*a* and an opposing second, front face 36*b*. Preferably, a resilient pad 38 is secured to the rear surface 36*a* of the base plate 36 and is configured to directly contact one of the opposing support surfaces to support the adjustable curved rod assembly 10 above a ground surface when the assembly is installed. The resilient pad 38 may be made of a rubber (natural or synthetic), foam, an elastomeric plastic or any other resilient material having a sufficiently high coefficient of friction to ensure secure mounting of the adjustable curved rod assembly 10 between the two opposing support surfaces.

A first flange 40 and a second flange 42 extend generally perpendicularly from the front face 36*b* of the base plate 36 of the first end support 32. The first and second flanges 40, 42 are spaced apart from each other so as to form a support space 44 therebetween. A first aperture 40*a* is formed in the first flange 40 and a second aperture 42*a* is formed in the second flange 42. Preferably, the first and second apertures 40*a*, 42*a* are generally aligned or in registry with each other.

With respect to the first end support 32, a first fastener assembly comprising a first fastening pin 52 and a first fastening pin end 54 is preferably utilized to secure the coupler 46 within the support space 44 formed between the first and second flanges 40, 42. Specifically, in the assembled position of the adjustable curved rod assembly 10, the first end 46*a* of the coupler 46 is positioned within the support space 44, such that the apertures 50 of the first end 46*a* of the coupler 46 are aligned or in registry with the first and second apertures 40*a*, 42*a* of the first and second flanges 40, 42. The first fastening pin 52 and the first fastening pin end 54 are then inserted through the first and second apertures 40*a*, 42*a* of the first end support 32 and the apertures 50 of the coupler 46. The first fastening pin 52 may be secured within the first fastening pin end 54 by any known conventional mechanisms, such as corresponding thread patterns, an adhesive, friction fit, an interference fit and the like. As such, the coupler 46, and more particularly the first end 46*a* of the coupler 46, is pivotably secured to the first end support 32. However, it will be understood by those skilled in the art that the coupler 46 may alternatively be fixedly secured to the first end support 32.

In the assembled position of the adjustable curved rod assembly 10, the second end 16*b* of the second tube 16 is similarly pivotably secured to the second end support 34 by a second fastening assembly comprising a second fastening pin 52 and a second fastening pin end 54 engages the first and second apertures 40*a*, 42*a* of the second end support 34 and the apertures 17 of the second end 16*b* of the second tube 16. As such, pivotal movement of the second tube 16 of the curved rod 12 is enabled.

Figure 6:
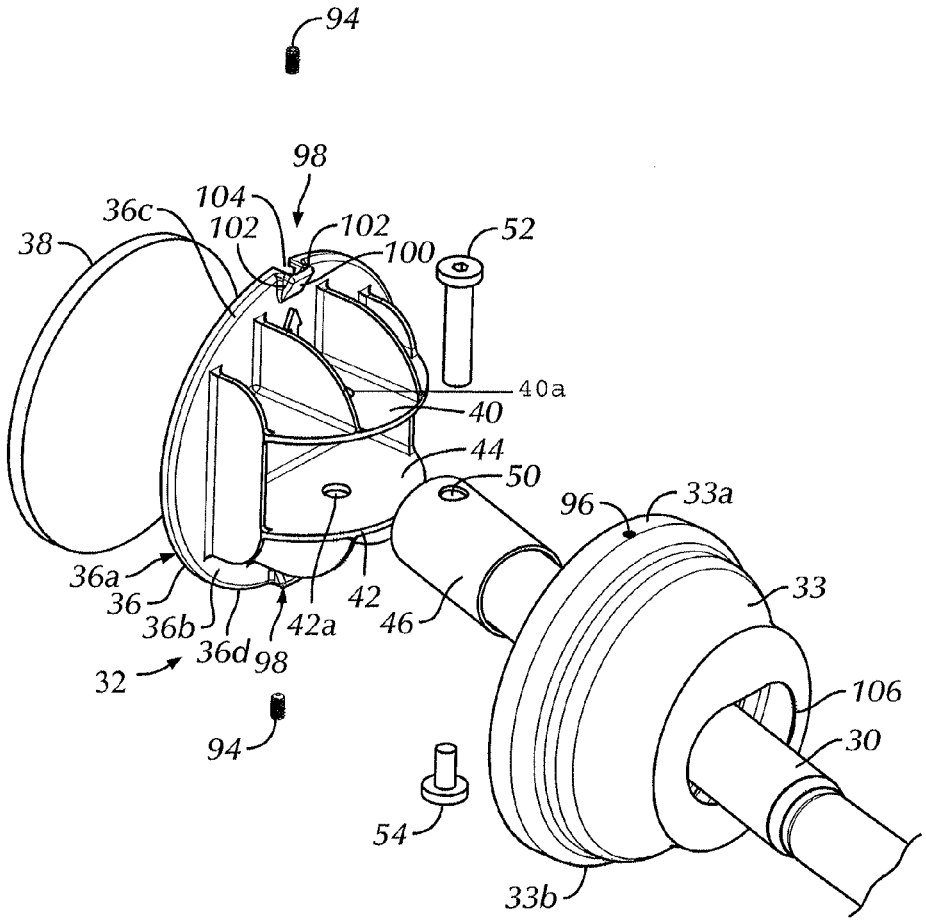

One or both of the first and second end supports 32, 34 may optionally be provided with a cover 33, and more particularly a decorative cover 33. In one embodiment, as shown in FIG. 6, the decorative cover 33 may be secured to the first end support 32, and more particularly the base plate 36 of the first end support 32, by at least one fastener 94. It will be understood that, though not depicted, the decorative cover 33 may be secured to the second end support 34, and more particularly the base plate 36 of the second end support 34, by at least one fastener 94 in a similar manner.

The fastener 94 cooperates with a first aperture 96 formed in the decorative cover 33 and a first indentation 98 formed in the base plate 36, respectively. More particularly, the aperture 96 is preferably formed in an upper end 33*a* of the decorative cover 33 and the indentation 98 is preferably formed in an upper end 36*c* of the base plate 36.

The indentation 98 is preferably a raised region of the rear face 36*b* of the base plate 36. The indentation 98 is preferably formed of an angled or inclined surface 100 and two opposing lateral sidewalls 102 extending transversely therefrom toward the base plate 36. The angled surface 100 and the lateral sidewalls 102 define a cavity 104 configured to receive the fastener 94 therein.

The aperture 96 and the cavity 104 of the indentation 98 are preferably aligned or in registry with each other, and more preferably, are axially aligned with the first and second apertures 40*a*, 42*a* of the first and second flanges 40, 42 and the apertures 50 of the coupler 46. To assemble the decorative cover 33 on one of the end supports 32, 34, the user first assembles the first tube 14, second tube 16, rotatable tube 30 and coupler 46, as described in more detail hereinafter. Then, the decorative cover 33 is positioned over the end support 32, 34, such that the aperture 96 of the decorative cover 33 and the cavity 104 of the indentation 98 of the base plate 36 are in registry with each other and generally axially aligned with the first and second apertures 40*a*, 42*a* of the first and second flanges 40, 42 and with the apertures 50 of the coupler 46. Finally, the user inserts the fastener 94 through the aperture 96 of the decorative cover 33 until a distal end of the fastener 94 engages the indentation 98, and more preferably the angled surface 100 of the indentation 98. Preferably, a proximal end of the fastener 94 remains generally flush with an exterior surface of the decorative cover 33.

The fastener 94 can be any fastener capable of fastening the decorative cover 33 to an end support 32, 34 to prevent relative movement. Preferably, the fastener 94 is a set screw, and more preferably a thumb set screw. However, it will be understood that the fastener 94 may alternatively be a clamp, a locking pin, a bolt, peg, dowel, nail, and the like.

In one embodiment, the base plate 36 further includes a second indentation 98 formed at a bottom end 36*d* thereof, and more particularly 180°, from the first indentation 98 formed at the upper end 36*c* of the base plate 36. Similarly, the decorative cover 33 preferably includes a second aperture (not shown) formed at a bottom end 33*b* thereof, 180° from the first aperture 96 formed at the upper end 33*a* of the decorative cover 33. A second fastener 94 is preferably received through the second aperture and in the cavity 104 of the second indentation 98 to secure the decorative cover 33 to the end support 32, 34.

Each decorative cover 33 further includes a third aperture 106, preferably located in the geometric center thereof, which is configured to receive the first end 46*a* of the coupler 46 or the second end 16*b* of the second tube 16 therethrough.

In use, to obtain an assembled adjustable curved rod assembly 10: the second end 14*b* of the first tube 14 is positioned within the first end 16*a* of the second tube 16 of the curved rod 12, such that the first and second tubes 14, 16 are telescopingly configured; the first end 14*a* of the first tube 14 of the curved rod 12 is positioned within the second end 30*b* of the rotatable tube 30 such that the first tube 14 and the rotatable tube 30 are telescopingly configured and the rotatable tube 30 is freely rotatable relative to the first tube 14; the connector portion 60 of the rod 22 of the tension mechanism 20 is fixedly secured within the first end 30*a* of the rotatable tube 30 and at least a portion of the threaded portion 28 of the rod 22 extends from the rotatable tube 30 into the first tube 14 where it is rotatably secured therein by the threaded bushing 70; the first end 30*a* of the rotatable tube 30 is rotatably secured within the second end 46*b* of the coupler 46 such that the locking pin 64 of the connector 62 is positioned within the aperture 48*a* of the intermediate wall 48 of the coupler 46; the first end 46*a* of the coupler 46 is pivotably secured to the first end support 32; and the second end 16*b* of the second tube 16 of the curved rod 12 is pivotably secured to the second end support 34.

If decorative covers 33 are desired, the first end 46*a* of the coupler 46 and the second end 16*b* of the second tube 16 are inserted through the apertures 106 of respective covers 33 prior to being secured to the first and second end supports 32, 34, respectively.

In the assembled adjustable curved rod assembly 10, while one end of the assembly 10 (i.e., the second end 16*b* of the second tube 16) is pivotably secured to the second end support 34, the other end of the assembly 10 is rotatably secured to the first end support 32. More particularly, while the coupler 46 is pivotably secured to the first end support 32, the rotatable tube 30 remains rotatable relative to the first end support 32. Thus, the rotatable tube 30 is rotatably secured to the first end support 32

To install the assembled adjustable curved rod assembly 10 in a bathtub or shower stall (not shown), the assembly 10 is positioned between the opposing support surfaces of the stall and the length of the curved rod 12 is adjusted until the initial desired length is achieved. As described above, the length of the curved rod 12 is adjusted by sliding the first and second tubes 14, 16 either toward or away from each other until the desired length is achieved.

The initial desired length of the curved rod 12 is dependent upon the distance between the opposing support surfaces and is achieved when the rear face 36*a* of the base plate 36 (or the resilient pad 38 attached thereto) of each end support 32, 34 is proximate a respective opposing support surface. More preferably, the initial desired length of the curved rod 12 is achieved when the rear face 36*a* of the base plate 36 or (the resilient pad 38 attached thereto) of each end support 32, 34 directly contacts or almost directly contacts a respective opposing support surface at generally the same height, such that the first and second tubes 14, 16 are generally horizontal in the mounted configuration.

In the embodiment of FIGS. 2A-2B, once the desired length is achieved, the spring-loaded pin 80 is received within a cooperating hole 82. The engagement between the pin 80 of the first tube 14 and a hole 82 of the second tube 16 ensures that the curved rod 12 maintains the desired length when secured between opposing support surfaces. In the embodiment of FIGS. 4-4A, the overall length of the curved rod 12 that can be achieved is limited by engagement of the rivet 84 and the first end 14*a* of the first tube 14 contacts the rivet 84. In the embodiment of FIGS. 5-5B, once the desired length is achieved, the fastener 90 is inserted through the aperture 88 of the second tube 16 until a distal end of the fastener engage a portion of the planar surface 86 of the first tube 14.

Finally, once the assembled adjustable curved rod assembly 10 is properly positioned between the two opposing support surfaces, the rotatable tube 30 can be manually rotated by a user to generate a tension or compressive force to be exerted by the adjustable curved rod assembly 10 upon the opposing support surfaces, such that the assembly 10 is maintained between the two opposing surfaces without the use of fasteners or adhesives. Specifically, when the assembled adjustable curved rod assembly 10 is positioned between the two opposing surfaces, the user manually rotates the rotatable tube 30 about its longitudinal axis L1, thereby adjusting the overall desired length of the rod assembly 10, until the rear surface 36*a* of the base plate 36 or (the resilient pad 38 attached thereto) of each end support 32, 34 directly contacts a respective opposing support surface and a compressive or tensile force, generated by the tension mechanism 20, is applied or exerted against the opposing support surfaces. A compressive or tensile force is also generated and exerted between the threads of bushing 70 and the threads of threaded portion 28 to maintain the position of bushing 70 along the threaded portion 28. As such, the adjustable curved rod assembly 10 is maintained between the two opposing surfaces without the use of fasteners or adhesives.

Those skilled in the art will appreciate that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An adjustable rod assembly comprising:

a first arcuate tube having a first end, a second opposing end, and at least one planar surface extending from at least the second end of the first arcuate tube toward the first end of the first arcuate tube;

a second arcuate tube, the second end of the first arcuate tube being telescopingly received within the second arcuate tube;

a third tube of a generally straight configuration, the first end of the first arcuate tube being telescopingly received within the third tube; and a fourth tube of a generally straight configuration, the third tube being rotatable relative to the first arcuate tube and being rotatably secured within the fourth tube;

a first end support configured to be removably mounted to a first support surface and a second end support configured to be removably mounted to a second support surface, the fourth tube being secured to the first end support and the second arcuate tube being secured to the second end support; and a tension rod mechanism fixedly secured within the third tube for rotational movement therewith, the tension rod mechanism having a threaded portion configured to extend into an interior of the first arcuate tube, the tension rod mechanism being configured to generate a compressive force which is exerted by the adjustable rod assembly upon the first and second support surfaces.

2. The adjustable rod assembly of claim 1, wherein the first arcuate tube has a substantially D-shaped cross-section.

3. The adjustable rod assembly of claim 2, wherein the second arcuate tube has a substantially circular cross-section.

4. The adjustable rod assembly of claim 1, wherein the fourth tube is pivotably secured to the first end support and the second arcuate tube is pivotably secured to the second end support.

5. The adjustable rod assembly of claim 1, wherein the interior of the first arcuate tube includes a threaded bushing configured to threadingly engage the threaded portion of the tension rod mechanism.

6. The adjustable rod assembly of claim 5, wherein the threaded bushing includes an exterior planar surface which engages the at least one planar surface of the first arcuate tube.

7. The adjustable rod assembly of claim 1, wherein rotation of the third tube in a first direction about a longitudinal axis of the third tube causes the first arcuate tube and fourth tube to move away from each other and wherein rotation of the third tube in a second opposite direction about the longitudinal axis of the third tube causes the first arcuate tube and fourth tube to move toward each other.

8. The adjustable rod assembly of claim 1, wherein the second arcuate tube includes at least one aperture of a size sufficient to allow a fastener to pass therethrough.

9. The adjustable rod assembly of claim 1, wherein at least a part of the threaded portion of the tension rod mechanism is flexible.

10. The adjustable rod assembly of claim 1, further comprising a cover removably secured to each of the first and second end supports, each cover having an aperture configured to receive a fastener therethrough.

11. The adjustable rod assembly of claim 10, wherein each of the first and second end supports includes a base wall having at least one indentation formed therein, the indentation including a cavity and an angled wall, the fastener passing through the aperture of the cover and engaging the angled wall of the indentation in an assembled position of the adjustable rod assembly.

12. The adjustable rod assembly of claim 1, wherein the tension rod mechanism comprises a connector fixedly secured with in the third tube and a pin which extends away from the threaded portion and engages an aperture formed in a wall of the fourth tube, such that the third tube is rotatably secured within the fourth tube.

* * * * *